United States Patent [19]

Antal et al.

[11] Patent Number: 4,861,302

[45] Date of Patent: Aug. 29, 1989

[54] PROCESS FOR FLUSHING AND FILLING A LOW PRESSURE GAS DISCHARGE LIGHT SOURCE

[75] Inventors: Kálmán Antal; László Ugrósdy; Béla Rimay, all of Budapest, Hungary

[73] Assignee: Tungsram Részvénytársaság, Budapest, Hungary

[21] Appl. No.: 146,531

[22] Filed: Jan. 21, 1988

[30] Foreign Application Priority Data

Jan. 23, 1987 [HU] Hungary ..... 204/87

[51] Int. Cl.[4] ..... H01J 9/38

[52] U.S. Cl. ..... 445/38; 445/53; 445/56

[58] Field of Search ..... 445/38, 40, 41, 42, 445/9, 16, 53, 56

[56] References Cited

U.S. PATENT DOCUMENTS

| | | | |
|---|---|---|---|
| 3,492,598 | 1/1970 | MacNair | 445/56 |
| 3,730,606 | 5/1973 | Hernquist | 445/53 |
| 3,788,725 | 1/1974 | Yannopoulos | 445/53 |
| 4,303,290 | 12/1981 | Tsunekawa | 445/56 |
| 4,364,617 | 12/1982 | Moriwaki | 445/53 |

FOREIGN PATENT DOCUMENTS

| | | | |
|---|---|---|---|
| 0039102 | 3/1980 | Japan | 445/53 |
| 0038536 | 3/1982 | Japan | 445/53 |

*Primary Examiner*—Kurt Rowan

*Attorney, Agent, or Firm*—Schweitzer & Cornman

[57] ABSTRACT

A process for flushing and filling a low pressure gas discharge lamp which has an exhaust tube and discharge electrodes at each of its ends and which is provided with a discharge vessel for limiting or bounding the gas discharge, wherein the course of the process the discharge vessel is coupled via the exhaust tubes to a pumping apparatus. Flushing or fill gas is continually charged into the discharge vessel via one of the exhaust tubes and simultaneously via the other exhaust tube the gas is discharged in such a manner that within the discharge vessel an equilibrium pressure prevails which coincides with the final charging pressure of the lamp, while the flow rate of the flowing gas is expediently maintained at a constant value.

7 Claims, 1 Drawing Sheet

PROCESS FOR FLUSHING AND FILLING A LOW PRESSURE GAS DISCHARGE LIGHT SOURCE

FIELD OF THE INVENTION

The invention concerns a process for flushing and filling a low pressure gas discharge light source which has at each of its ends a respective exhaust tube and discharge electrodes, is filled with an inert gas and is constructed with a discharge vessel bounding the discharge, wherein the ratio between the internal diameter of the dischrge vessel and the length of the discharge arc is at most 1:10. In the course of the process according to the invention the discharge vessel is coupled via the exhaust tubes to a pump whereafter it is exhausted or pumped out and filled with a flushing or filling gas; the charge pressure of the discharge vessel is adjusted and the carbonates at the cathodes are dissociated to oxides, whereafter the exhaust tubes (tubulations) are tipped-off.

BACKGROUND OF THE INVENTION

In the course of production of light sources of the above-mentioned character the productivity of the pumping technology employed is determined by the volume of the discharge vessel and the duration of pumping required for dissociating the carbonates at the cathodes.

According to a known, currently used process a rapid exhaustion of the discharge space to a very high quality is achieved by pumping from both ends and by a reduction of the flow resistance. In order to be able to achieve the aim set, at both sides exhaust tubes of minimum length are used or exhaust tubes are not utilised at all. Flushing gas is introduced in several stages into the discharge vessel and pumping out takes place at both ends of the light tube simultaneously.

A disadvantage of this process consists in that the space and energy requirements are very high as a consequence of the required pumping output. Because of the pumping taking place at both sides problems are involved in the dismantling of the vacuum gas system connected to one of the exhaust tubes, with regard to the purity of the vacuum.

In German Federal Republic patent No. 30 03 700 a process for pumping out discharge vessels is described wherein gas is introduced only through one of the exhaust tubes of a discharge vessel while at the other exhaust tube only pumping out occurs, and in the course of which in the first phase of the pumping a discharge vessel is pumped out to a pumping pressure value which is higher than the charge pressure of a discharge vessel, whereafter flushing gas is introduced into the interior of the discharge vessel via the pumping tube on the gas side, and this gas is pumped out via the other exhaust tube while simultaneously maintaining the pumping pressure value. Flushing through is undertaken at a predetermined gas velocity during a certain time period; during this also the carbonates are dissociated to oxides at the cathodes. In the next phase of the pumping ot the gas pressure prevailing in the discharge vessel is reduced to the charging pressure corresponding to the type of the discharge vessel and moreover in such a manner that the gas supply is first blocked and after attaining the charging pressure, the pumping is terminated and the exhaust tubes at both sides are tipped off (sealed).

A disadvantage of this solution is that the gas flushing undertaken at a high pressure value causes the consumption of much excess gas which significantly increases the costs of the process. Furthermore the adjustment of the charging pressure with the required accuracy is rather complicated, which can be traced back to the dimensional tolerances of the exhaust tube at the suction side and which in turn causes a significant change in the flow velocity.

A further drawback lies in that the time required for the pumping process is too long as a consequence of the adjustment of the pressure to the charge pressure.

DESCRIPTION OF THE INVENTION

The aim of the present invention is to provide a process for flushing and filling a low pressure gas discharge light source which simultaneously avoids the shortcomings of the known processes and which is of the highest productivity and economy, and which can assure the gas purity which is so important for the lamp quality as well as a stable charge gas pressure while enabling a configuration of a pumping system which is as simple as possible.

The invention is based on the discovery that the gas purity achievable at the end of the pumping cycle and the stability of the charging pressure may be considerably influenced by the pressure stages adjusted or set during flushing and pumping out of the gas.

Accordingly, our invention concerns a process for flushing and filling a low pressure gas discharge lamp as a light source filled with an inert gas which comprises at both ends a respective exhaust tube and discharge electrodes and which is provided with a discharge vessel for bounding or limiting the discharge, and wherein the ratio between the internal diameter of the discharge vessel and the length of the discharge arc is at most 1:10. In the course of the process the discharge vessel is coupled to a pump via the exhaust tube. After the discharge vessel has been pumped out and filled with flushing or fill gas, the pressure is adjusted to the final charging pressure of the discharge vessel and the carbonates are dissociated at the cathodes to form oxides, whereafter the exhaust tubes are tipped off. In accordance with the invention the process is carried out in such a manner that the flushing gas or filling gas is continually supplied via one of the exhaust tubes into the discharge vessel which is connected to the pump and simultaneously it is pumped via the other exhaust tube in such a measure or extent that an equilibrium pressure comes about in the discharge vessle which pressure corresponds with the final charging pressure of the discharge vessel.

By virtue of the fact that the supply of the gas takes place simultaneously with the pumping out a more intensive through-flushing is achieved because the continuous gas stream flowing is through one of the exhaust tubes drives contaminations before it, approximately in the manner of a piston, and the contaminations are driven relatively rapidly through the other exhaust tube of the discharge vessel out of the interior of the latter. In this way not only is the speed of removal of contaminations increased but so also is the efficiency of the latter because the flow conditions arising within the discharge vessel prevent the contaminations from remaining in the discharge tube and in the corner regions bounded by the closure elements.

According to a further advantageous embodiment of the process according to the invention flushing or filling gas is introduced into the discharge vesel via one of the exhaust tubes in such a quantity that the velocity of the gas flowing into the discharge vessel remains constant. In relation to the duration of the whole pumping process this constat gas flow velocity may be increased at most once for a short time period, at most by up to 10% in an impulse-like manner should such an increase be required for other working processes required by the lamp technology.

According to an advantageous form of the process according to the invention the composition of the filling or flushing gas charged into the discharge vessel may be changed for a flushing period before the termination of the process; such a change may be advantageous when the gas utilised for filling the lamp is expensive, e.g. krypton. In such a case the discharge vessel is first charged with flushing gas and this is changed to the fill gas only when the dissociation of the carbonates at the cathodes has terminated. After at time delay corresponding to a through-flushing period both exhaust tubes of the discharge vessel are tipped off or sealed.

It is also to be regarded as expedient when the dissociation of the carbonates at the cathodes is undertaken mutually independently in time, and moreover in such a manner that first one treats the cathode adjacent to the gas supply exhaust tube and then, after a period corresponding to the course of the through flushing period, the cathode remote from the gas supply pipe is treated because in this way the large quantity of gases arising in the dissociation of the carbonates, such as carbon dioxide and carbon monoxide and others which represent contaminations for the cathodes cannot influence the already treated cathode surfaces.

The pumping process according to the invention with a single stage pressure adjustment is extremely advantageous from the point of view of the exact maintenance of the gas consumption, the gas purity and the charge pressure, because the achievable gas purity corresponds with the purity of the supply gas. A separate gas supply system is obviated and by virtue of the gas flushing undertaken at a low pressure value a significant amont of gas may be saved, while the charge pressure may be maintained at a constant value during the whole process.

DESCRIPTION OF THE DRAWING

The invention is described in greater detail with reference to the accompanying drawing in which.

DESCRIPTION OF THE PREFERRED EMBODIMENT

In accordance with the invention the discharge vessel of a low pressure gas discharge lamp is connected to a per se known pump by way of one of the exhaust tubes provided at both ends; via the other exhaust tube flushing gas is supplied and filled into the discharge vessel and simultaneously therewith the gases disposed in the interior of the discharge vessel together with any contaminations that may be present as well as the supplied flushing gas are pumped out via the first exhaust tube.

Figure 1:
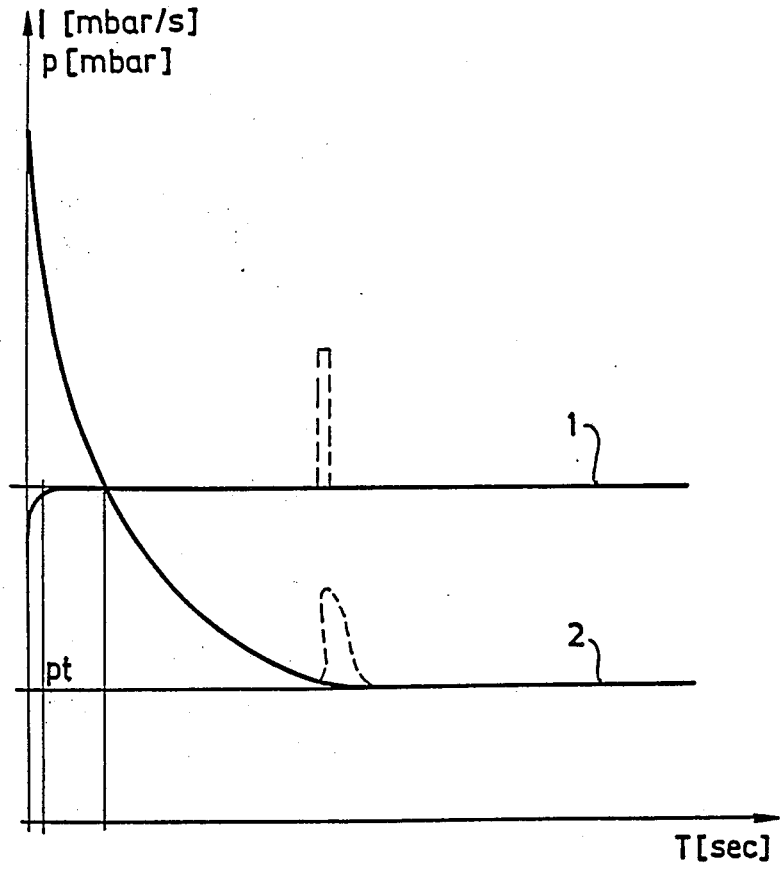
FIG. 1 is a graph of the changes in pressure and gas flow velocity in the discharge vessel as a function of time during the pumping cycle.

As may be well seen from curve 1 in FIG. 1, during the whole pumping cycle for the light source the flushing gas flows continuously and essentially at a constant rate.

Pumping out is undertaken to such an extent that the pressure prevailing in the discharge vessel according to curve 2 first falls continuously and then is adjusted to an equilibrium pressure value coinciding with the final charge pressure $p_f$ of the discharge lamp. The adjusted pressure depends on the constant flow rate and on the flow resistance of the exhaust tube of the discharge vessel at the pumping side.

In FIG. 1 broken lines in curves 1 and 2 represent those versions of the process according to the invention in which, as shown in the Figure, once or even more than once during the pumping cycle the pressure and flow rate of the streaming flushing gas is increased in a pulse-like manner for an extremely short time period relative to the duration of the whole cycle, this period being at most up to 10% of the whole duration of the cycle.

This process step may be successfully utilised e.g. for the supply of additives into the discharge vessel.

Figure 2:
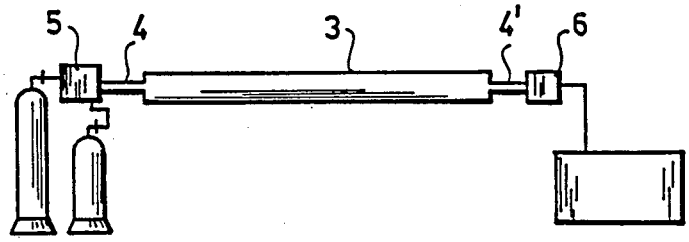
FIG. 2 is a preferred embodiment of a pumping system for realising the process according to the invention.

FIG. 2 schematically illustrates the pump for carrying into practice the process according to the invention. The discharge vessel 3 is connected into the pumping circuit of a per se known pump via exhaust tubes 4, 4'. Via the exhaust tube 4 coupled to a gas head 5 and via an exhaust tube 4' coupled via a pumping head 6 the flushing gas or fill gas is supplied and pumped out, respectively.

Should the fill gas and flushing gas of the discharge lamp not be the same, then a changeover valve (not shown) is included in the gas head 5 with the aid of which on switching over from flushing gas to fill gas from the chamber or space containing the flushing gas, the pressure of which exceeds atmospheric pressure, one may without further measures change over to a pressure equal to that in the fill gas space or chamber.

It follows from the simple construction of the pumping apparatus that contaminants cannot pass into the gas head 5 because always pure gas flows through the gas head 5, whereby the entry of contaminants into the system is prevented.

We claim:

1. A process for flushing and filling a low pressure gas discharge light source having a discharge vessel containing a cathode at each end and carbonates at said cathodes, said discharge vessel being adapted to contain an electrical discharge arc, the maximum ratio of the internal diameter of the discharge vessel and the length of the arc being 1:10, said discharge vessel having a first end, a discharge tube connected to said first end for attachment from a vacuum pump, said discharge vessel having a second end, a charging tube connected to said second end for attachment from a gas charging source, the process which takes place entirely within a few seconds, comprising dissociating the carbonates into their corresponding oxides, while exhausting the contents of said discharge vessel through said discharge tube, and substantially simultaneously with said exhausting charging the interior of the discharge vessel through said charging tube with a charge of flushing or filling gas while adjusting to an equilibrium pressure between the exhaust and the charge, said equilibrium pressure being approximately the same as the ultimate charge pressure within said discharge vessel, and then tipping off said discharge tube and said charging tube.

2. The process of claim 1, wherein said charging and discharge take place at a substantially constant gas flow rate.

3. The process of claim 2, wherein the constant flow rate of the flushing or filling gas is pulse-like increased for a maximum time period of 1/10 of said few seconds duration of the process.

4. The process of claim 1, wherein the composition of the gas entering through said charging tube is briefly changed for through-flushing the interior of said discharge vessel.

5. The process of claim 4, wherein said through flushing takes place immediately before the completion of the process.

6. The process of claim 1, wherein first the carbonates are dissociated at the electrode that is closer to the exhaust tube, and before dissociating the carbonates at the electrode that is closer to the charging tube.

7. The process of claim 6, wherein a through flushing is carried out after the first dissociation of the carbonates and before the second dissociation of the carbonates.

* * * * *